US006708856B1

(12) United States Patent
Yamamoto

(10) Patent No.: US 6,708,856 B1
(45) Date of Patent: Mar. 23, 2004

(54) AUTOMOTIVE TOOL TRAY AND SUPPORT ASSEMBLY

(76) Inventor: Paul Kiyoshi Yamamoto, 766 Ilaniwai St., Honolulu, HI (US) 96813

( * ) Notice: Subject to any disclaimer, the term of this patent is extended or adjusted under 35 U.S.C. 154(b) by 26 days.

(21) Appl. No.: 10/243,008

(22) Filed: Sep. 13, 2002

(51) Int. Cl.[7] ..... A47B 23/00

(52) U.S. Cl. ..... 224/488; 108/44; 224/523; 224/544

(58) Field of Search ..... 224/488, 523, 224/544; 280/727; 296/37.1; 108/44; 248/146, 151, 163.1

(56) References Cited

U.S. PATENT DOCUMENTS

| | | | | | |
|---|---|---|---|---|---|
| 1,723,238 | A | * | 8/1929 | Hoot | 108/44 |
| 2,901,303 | A | * | 8/1959 | Anderson | 108/44 |
| 2,962,333 | A | * | 11/1960 | Policastro | 108/44 |
| 3,015,530 | A | * | 1/1962 | Anderson | 108/44 |
| 3,698,330 | A | * | 10/1972 | Krombach | 108/44 |
| 4,488,497 | A | | 12/1984 | Bevans | |
| 4,728,065 | A | | 3/1988 | Coote | |
| 4,811,875 | A | * | 3/1989 | DiSimone | 108/44 |
| 4,911,083 | A | | 3/1990 | Considine | |
| RE33,645 | E | | 7/1991 | Coote | |
| 5,331,904 | A | | 7/1994 | DiSimone et al. | |
| 5,443,019 | A | | 8/1995 | Sheldrick | |
| 5,685,468 | A | * | 11/1997 | Hernandez et al. | 224/488 |
| 5,699,910 | A | | 12/1997 | Kubat | |
| 5,873,311 | A | | 2/1999 | Schlattl | |
| 5,937,766 | A | | 8/1999 | Denny | |
| 6,026,954 | A | | 2/2000 | Marsh | |
| 6,041,717 | A | | 3/2000 | Kubat | |
| 6,082,270 | A | * | 7/2000 | Zerger | 108/44 |
| 6,240,856 | B1 | | 6/2001 | Paskey et al. | |

OTHER PUBLICATIONS

Affidavit of Paul Kiyoshi Yamamoto.

* cited by examiner

*Primary Examiner*—Gary E. Elkins
(74) *Attorney, Agent, or Firm*—Martin E. Hsia

(57) ABSTRACT

An automotive tool tray and support assembly that can be removably engaged with and affixed to the hood-latch mechanisms of automobiles having rear-raising engine hoods. The support assembly comprises two hollow support members, with an extendable insert movably disposed within the support member. Both support members are substantially rigidly and removably affixed to their respective hood latch mechanisms by inserting the inserts in the hood latch mechanisms. The hood latch mechanisms engage with and retain the inserts, and the support members rest on the hood latch mechanism housings. An automotive tool tray is positioned over the exposed engine compartment by affixing the tray to the top ends of the support members.

6 Claims, 10 Drawing Sheets

AUTOMOTIVE TOOL TRAY AND SUPPORT ASSEMBLY

TECHNICAL FIELD

This invention relates to the field of automotive tool trays, and specifically relates to an automotive tool tray that straddles the engine compartment of automobiles having rear-raising hoods.

BACKGROUND ART

In most modem automobiles, the hood covering the engine compartment opens from the front of the automobile—called a front-raising hood. In this configuration, the hood is kept closed by a latch located in the front-portion of the engine compartment. When this latch is released, the front of the hood is raised on hinges located at the rear portion of the engine compartment. However, certain automobiles, such as most models of the Chevrolet Corvette, are or have been manufactured with rear-raising engine hoods that raise on a hinge or hinges located at the front-portion of the engine compartment. For some automobiles having rear-raising hoods, the hood and left and right fenders are formed as a single piece, such that both the hood and fenders are raised to access the engine compartment. This is commonly known as a unitary hood and fender. For simplicity purposes, the term "rear-raising hoods" shall also include rear-raising unitary hood and fenders. Automobiles having rear-raising hoods conventionally have two hood latches, one on either side of the engine compartment, located in the rear portion of the engine compartment. When the rear-raising hood is lowered, the hood latches retain the hood in the closed position.

In all automobiles—whether manufactured with rear-raising or front-raising engine hoods—it is generally inevitable that maintenance, repair or some other service will be required to be performed in the engine compartment. Whether such servicing is done by a professional or amateur automobile mechanic, most types of servicing require the use of tools and spare automotive parts. While performing automotive servicing, it is usually ideal to have tools and parts within close reach of the mechanic. Placing tools and parts within the engine compartment itself is problematic because there are usually no convenient surfaces upon which to place tools and parts. Furthermore, placing tools and parts directly within the engine compartment may cause the loss of parts within the engine compartment. This is especially dangerous if a tool or a part becomes lost or left (unbeknownst to the mechanic) near or on a moving engine part, thus causing damage to the engine, and possibly injuring the driver or others. Placing tools and parts on other parts of the automobile may result in damage, such as scratches or dents, to the automobile, and is similarly undesirable. While placing tools and parts on a table or tray away from the automobile is probably the safest alternative, it requires the mechanic to temporarily stop whatever task he or she may be doing in the engine compartment, turn about to retrieve the tool or part, then return to the task. This is highly inefficient, undesirable and unrealistic, especially if the mechanic must simultaneously hold a tool or part in place while requiring a new tool or part. A professional mechanic's inefficiency results in increased costs for the consumer.

Therefore, to increase the efficiency and safety of working on an automobile, various types of automotive tool trays have been developed to assist the mechanic by providing a place to hold tools and parts within easy reach of the mechanic. Unfortunately, most, if not all, of these automotive tool trays have been designed for an automobile with a front-raising hood. For example, U.S. Pat. No. 5,443,019 to Sheldrick, U.S. Pat. No. 5,937,766 to Denny, U.S. Pat. No. 6.026,954 to Marsh, U.S. Pat. No. 5,331,904 to DiSimone, et al, and U.S. Pat. No. 5,873,311 to Schlattl, would not be suitable for automobiles having a rear-raising unitary hood and fender because these types of tool trays rest on the edge of the engine compartment formed by the fender. For an automobile having a rear-raising unitary hood and fender, the fender is raised together with the hood, and therefore there is no edge upon which to rest the tool tray. Furthermore, unlike automobiles having front-raising hoods, automobiles having rear-raising hoods require the mechanic to service the engine compartment exclusively from the sides of the automobile. The above inventions are designed to straddle the engine compartment to accommodate a mechanic that can service the engine compartment from the front as well as the sides. Use of these types of tool trays would obstruct access to most of the engine compartment for automobiles with rear-raising hoods, thus making it difficult for a mechanic to service such automobiles. Furthermore, the above-mentioned automotive tool trays are not firmly affixed in place, and are susceptible to jostling or overturning, which could spill tools and parts into the engine compartment. In addition, tool trays that must be rolled to a position over the engine compartment, such as the types described by U.S. Pat. No. 4,488,497 to Bevans, U.S. Pat. No. 4,728,065 to Coote, U.S. Pat. No. Re. 33,645 to Coote, and U.S. Pat. No. 6,240,856 B1 to Paskey, et al, are unsuitable for an automobile having a rear-raising hood because the hood and wheel of such automobiles would prevent the tray from being rolled into a proper position over the engine compartment. It is of course desirable that any tool tray be easily manufactured from inexpensive materials and easily assembled and used by a single person.

DISCLOSURE OF INVENTION

This invention comprises an automotive tool tray having a support assembly that can be removably engaged with and affixed to the hood-latch mechanisms of automobiles having rear-raising engine hoods. The support assembly preferably comprises two support members, one for engagement with each hood latch mechanism, and an automotive tool tray. Each support member has a foot end, a top end, and a leg having a latch end portion adapted to be engagable with and retained by a corresponding hood latch mechanism in the rear of the engine compartment. The foot ends of the support members rest on the hood latch mechanism housing.

Both support members are substantially rigidly and removably affixed to their respective hood latch mechanisms by inserting the latch end portion of each leg into its respective hood latch mechanism. The hood latch mechanisms engage with and retain the latch end portions of the legs, and the foot ends of the support members rest on the hood latch mechanism housings. The automotive tool tray is positioned over the exposed engine compartment by affixing the tray to the top ends of the support members.

BEST MODES FOR CARRYING OUT INVENTION

Figure 1:
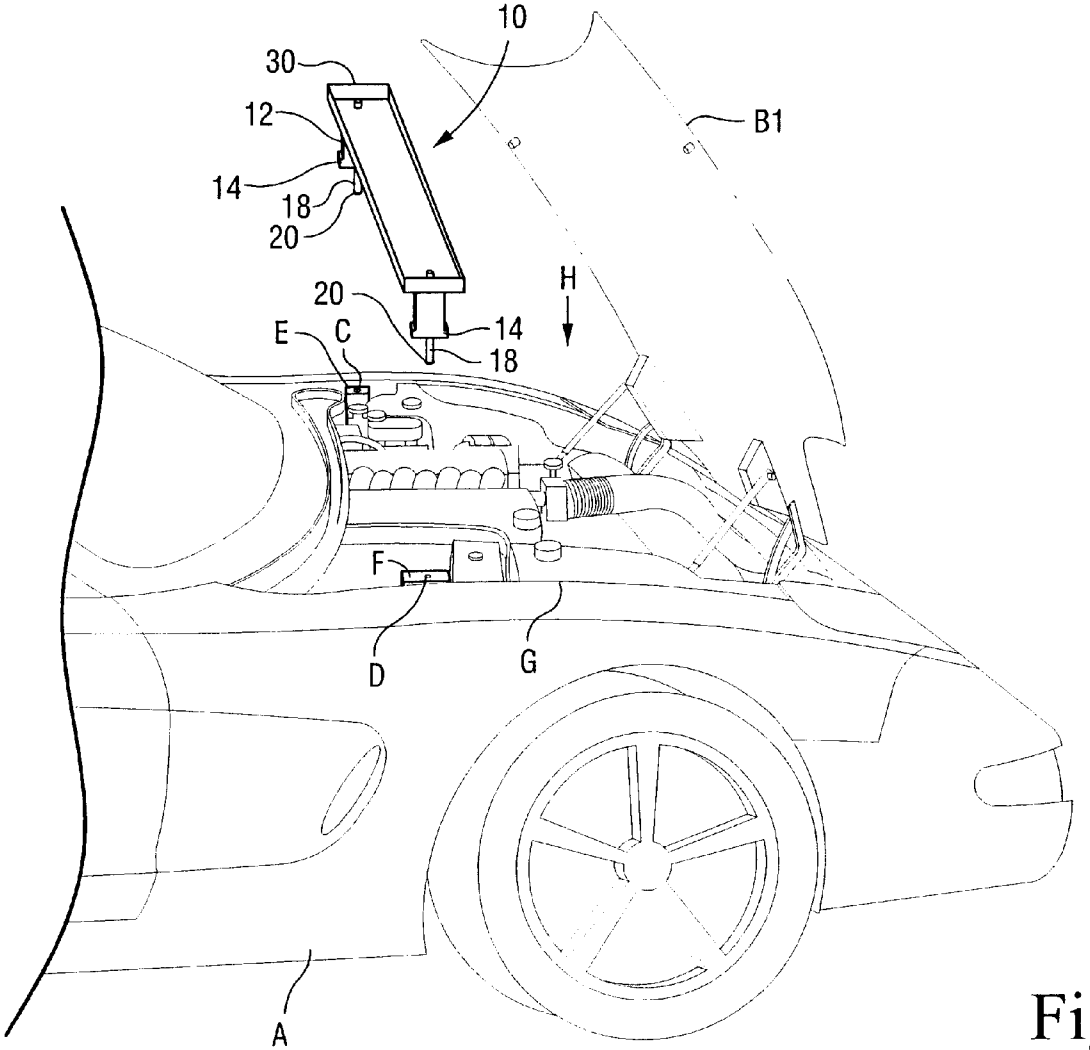
FIG. 1 is a side perspective view of a presently preferred embodiment of the invention in relation to an automobile having a rear-raising hood.
Figure 2:
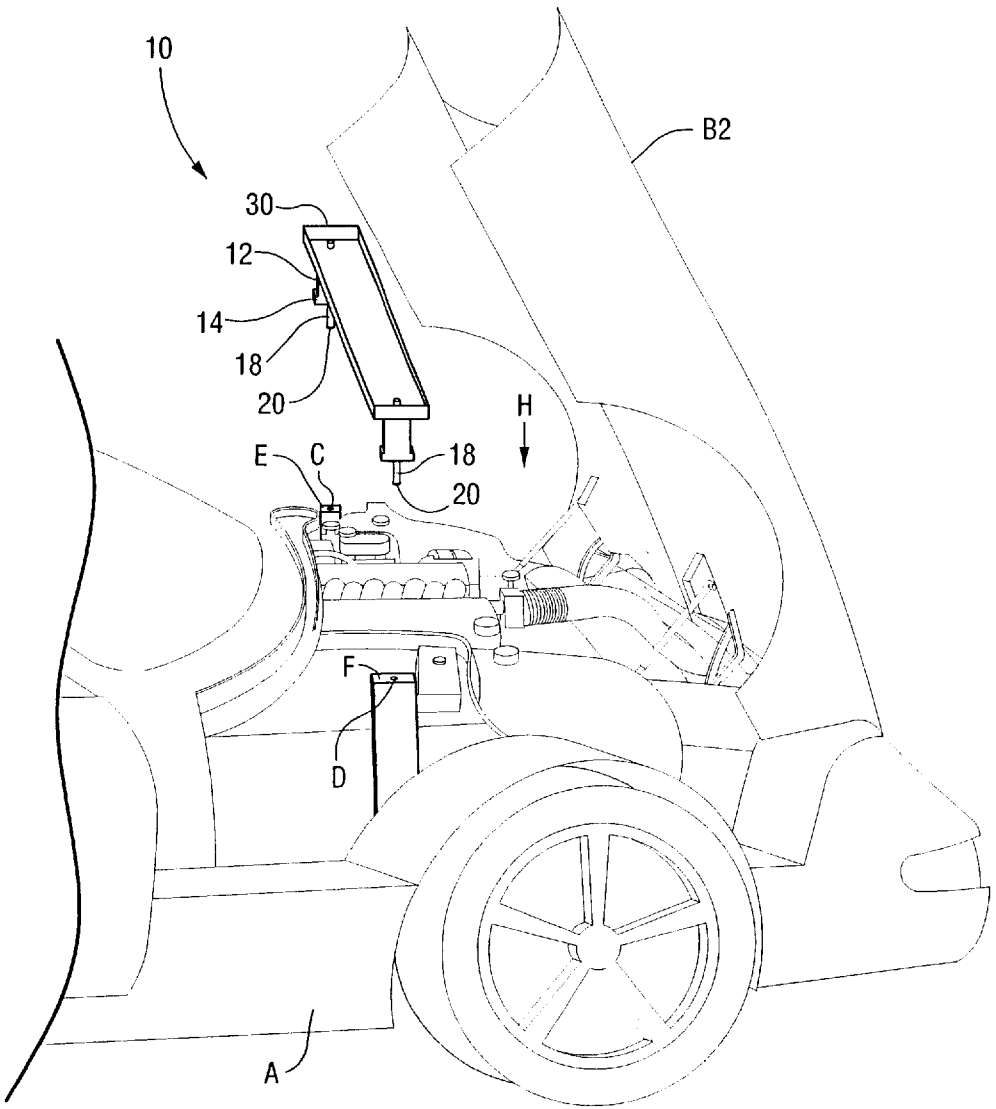
FIG. 2 is a side perspective view of the embodiment of FIG. 1 showing the invention in relation to an automobile having a rear-raising unitary hood and fender.

The presently preferred best mode for carrying out the present invention is illustrated by FIGS. 1 through 10. Automobiles having rear-raising hoods conventionally comprise two types—having a rear-raising hood or having a rear-raising unitary hood and fender—as shown in FIGS. 1 and 2, respectively. Referring to FIG. 1, a presently preferred embodiment of the invention 10 is shown in relation to an automobile A having a rear-raising hood B1. Referring to FIG. 2, the invention 10 is shown in relation to an automobile A having a rear-raising unitary hood and fender B2. As shown in FIG. 2, automobiles A having a rear-raising unitary hood and fender B2 conventionally lack the fender lip G that forms the edge of the engine compartment of automobiles having a rear-raising hood (as illustrated in FIG. 1) or an automobile having a front-raising hood (not shown). The absence of this fender lip G prevents the use of many types of automotive tool trays, as discussed above.

The invention 10 is designed for use with automobiles A having either a rear-raising hood B1 or rear-raising unitary hood and fender B2. Aside from the type of hood, automobiles A having rear-raising hoods conventionally have common design features. Automobiles A of this type conventionally have hood latches comprising a hood latch mechanism and housing. Referring to FIGS. 1 and 2, an automobile A is shown with a left hood latch mechanism C contained within a housing E, and a right hood latch mechanism D contained within a housing F. For clarity and simplicity, the left/right convention used herein shall be taken from the perspective of a driver. Therefore, the driver's left denotes the left side of the automobile, and the driver's right denotes the right side of the automobile. The left hood latch C and right hood latch D secure the hood B1, B2 to the frame of the automobile A when the hood B1, B2 is closed. A hood latch is conventionally a latch mechanism contained in a housing. The latch mechanism conventionally lockingly receives and releasably retains hooks (not shown) in the hood. The left hood latch mechanism C and housing E is conventionally located at the left rear of the engine compartment H of an automobile A, as shown in FIGS. 1 and 2. The right hood latch mechanism D housing F is conventionally located at the right rear of the engine compartment H of an automobile A, as shown in FIGS. 1 and 2.

Figure 3:
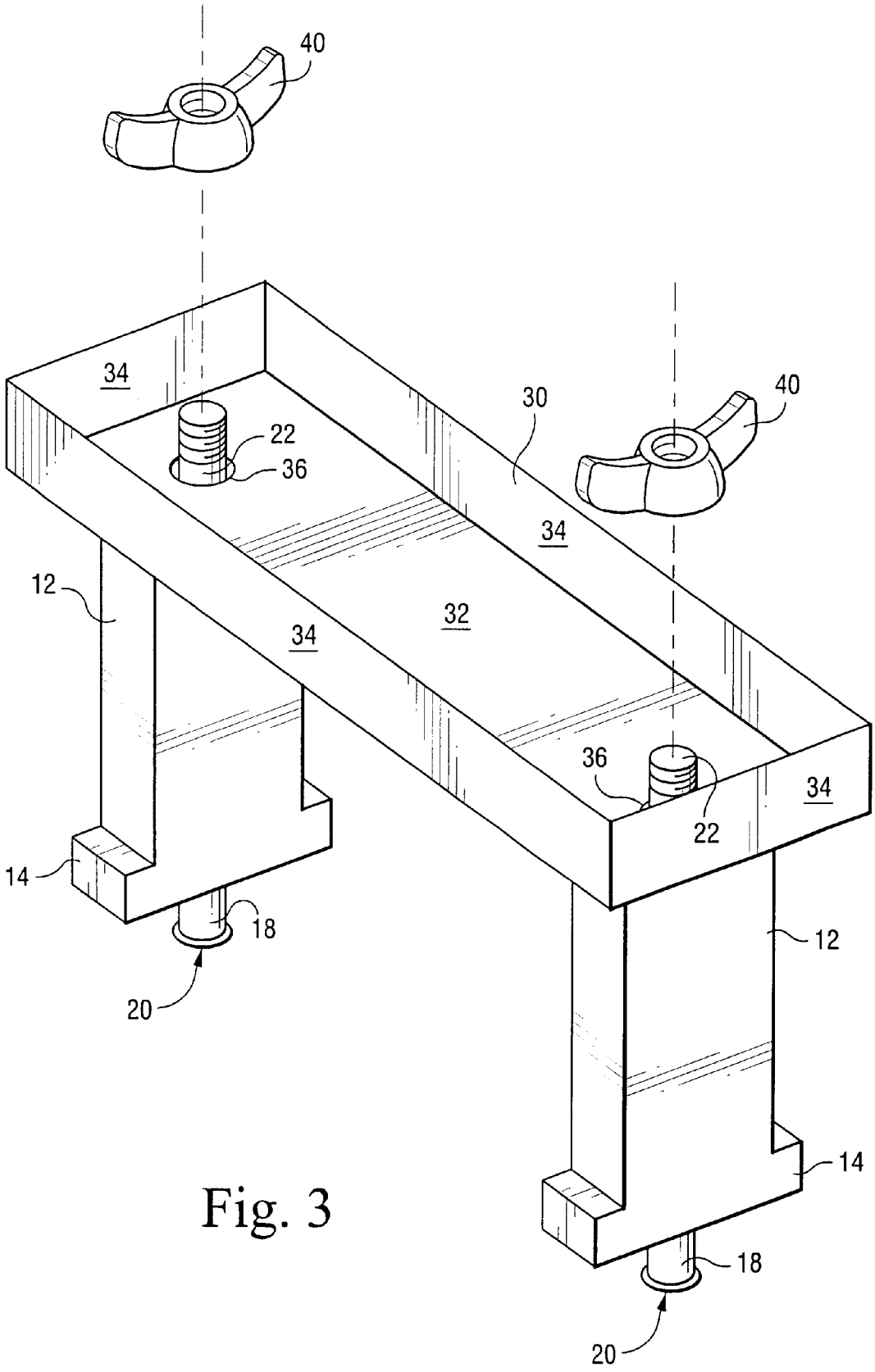
FIG. 3 is a side perspective view of an assembled automotive tool tray and support assembly according to the present invention, showing the extension of the top end portions of the inserts through the automotive tool tray to be affixed to the tool tray via tightening fasteners, in this case wingnuts, to be tightened on the threaded top end portion of the inserts.
Figure 4:
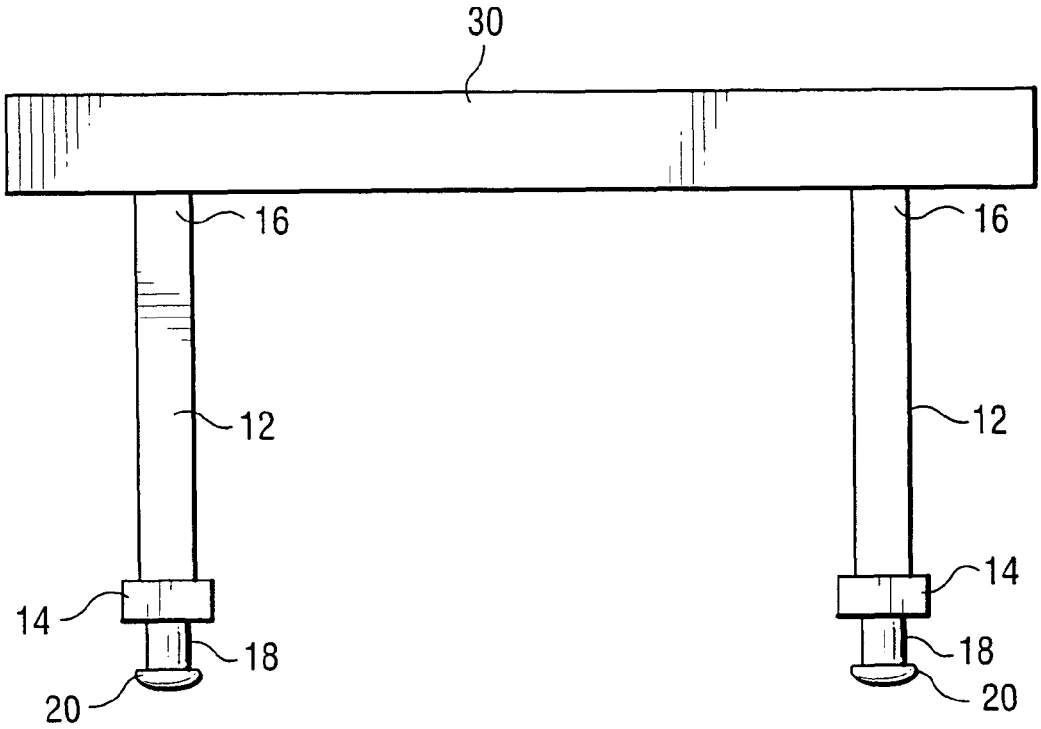
FIG. 4 is a front elevational view of the assembled automotive tool tray and support assembly of FIG. 3.

The invention 10 utilizes the hood latch mechanisms C, D and housings E, F to remain in place over the engine compartment H. Referring to FIGS. 3 and 4, an assembled automotive tool tray and support assembly according to the present invention generally comprises three components: two support members 12 and a tool tray 30. The two support members 12 are preferably substantially identical.

Figure 5:
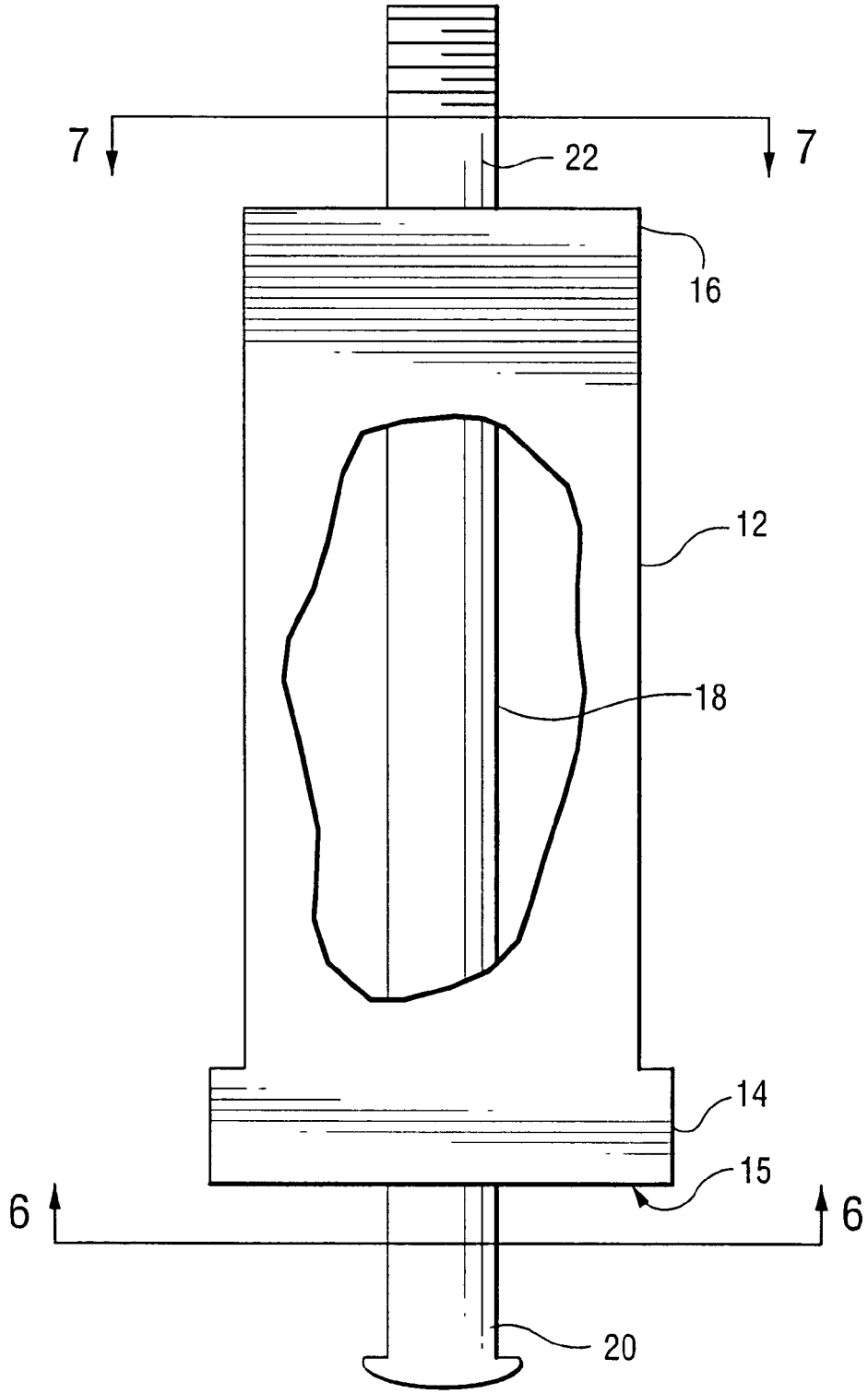
FIG. 5 is a side elevational cutaway view of a support member, showing the movably disposed insert within the member and the latch end portion of the insert extending from the foot end of the member.
Figure 6:
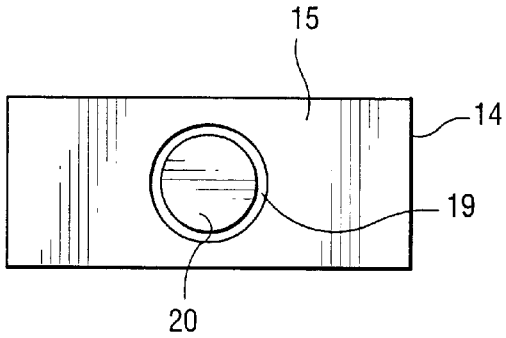
FIG. 6 is a view of the bottom of the support member of FIG. 5 along the line 6—6, showing the latch end portion of the insert extending from the foot end of the member.
Figure 7:
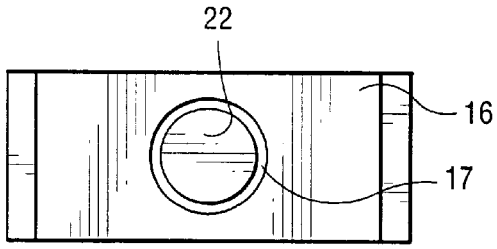
FIG. 7 is a view of the top of the support member of FIG. 5 along the line 7—7, showing the top end portion of the insert extending from the top end of the member.

FIGS. 5 through 8 show the presently preferred embodiment of a support member 12 of the present invention. Referring to FIG. 5, the support member 12 is preferably substantially hollow and comprises a foot end 14 and an open top end 16. The foot end 14 and the top end 16 of the support member 12 define the support member length. The foot end 14 has a bottom surface 15 with an aperture 19 substantially centrally located on the bottom surface 15 as shown in FIG. 6. The top end 16 has a top surface opening 17 as shown in FIG. 7. Referring again to FIG. 7, although the top surface opening 17 is shown as a circular aperture, it is not limited to this shape. The top surface opening 17 must be at least large enough to allow the top end portion 22 of the insert 18 to movably extend from the top end 16 of the support member 12 (described below). Therefore, the top surface opening 17 may be an aperture slightly larger than the cross-sectional area of the insert 18, or may be an opening co-extensive with the hollow interior of the support member 12.

Figure 8:
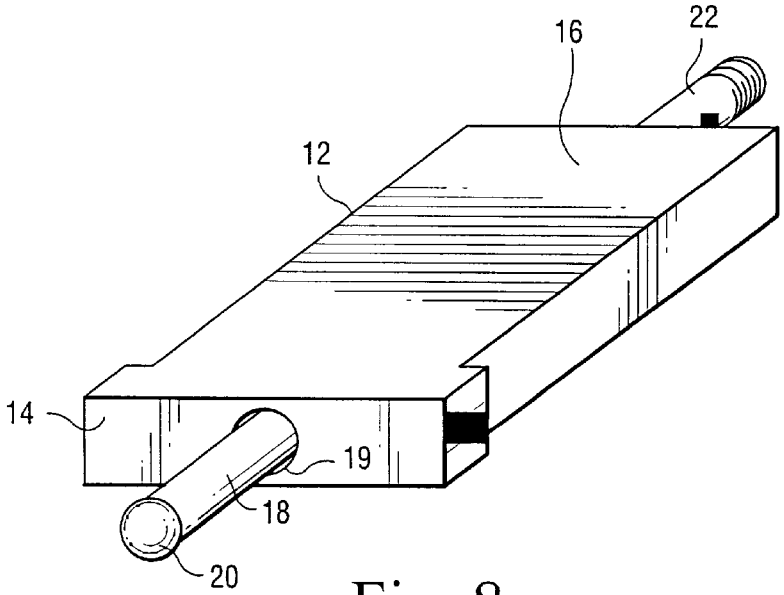
FIG. 8 is a side perspective view of the support member of FIG. 5 in a horizontal orientation.

Referring to FIG. 5, an insert 18 having a latch end portion 20 and a top end portion 22, is preferably movably disposed within the support member 12. The latch end portion 20 and the top end portion 22 of the insert 18 define the length of the insert 18. Referring to FIGS. 6 to 8, the latch end portion 20 of the insert 18 preferably movably extends from the aperture 19 in the foot end 14 of the support member 12 and the top end portion 22 of the insert 18 preferably movably extends from the top surface opening 17 in the top end 16 of the support member 12. The remainder of the insert 18 is preferably movably disposed within the support member 12.

Figure 9:
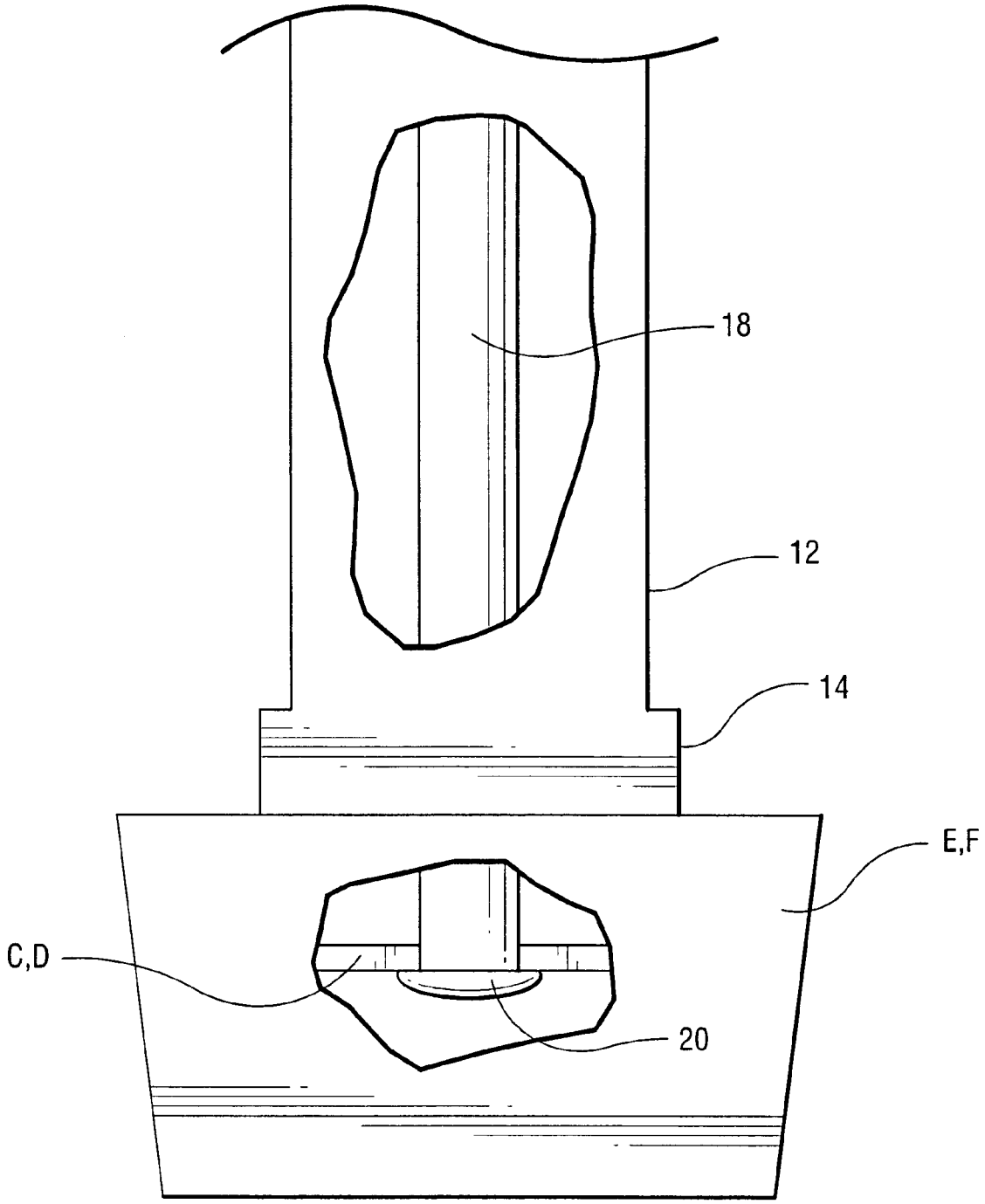
FIG. 9 is a side elevational cutaway view of the foot end of the support member of FIG. 5, showing the latch end portion of an insert inserted in a hood latch mechanism and the foot end of the member resting on the hood latch mechanism housing.

Referring to FIGS. 6 and 8, the area of the aperture 19 in the bottom surface 15 of the foot end 14 of the support member 12 is preferably slightly larger than the cross-sectional area of the insert 18, which allows the latch end portion 20 of the insert 18 to extend through the bottom surface 15 of the foot end 14 of the support member 12. The latch end portion 20 of the insert 18 is preferably adapted to be inserted into a hood latch mechanism C, D. Referring to the drawings, for simplicity purposes, the insert 18 has been illustrated as having a cylindrical shape. However, the insert 18 is not limited to a cylindrical shape or to a circular cross-section. The insert 18 can be any one of a number of shapes, and its cross-section may even vary throughout the length of the insert 18. However, regardless of the shape or cross section of the insert 18, the latch end portion 20 is preferably adapted to be inserted into a hood latch mechanism C, D, as shown in FIG. 9. Therefore, the latch end portion 20 as well as the remainder of the insert 18 may be any one of a number of similar or dissimilar equivalent structures that are well within the skill of an ordinary artisan.

Referring to FIGS. 5 and 8, the top end portion 22 of the insert 18 extends through top surface opening 17 of the support member 12. As shown in FIG. 6, the top end portion 22 of the insert 18 is preferably adapted to be received by and affixed to a tool tray 30. The top end portion 22 of the insert 18 may be any one of a number of different configurations. Although for simplicity only one configuration is described in detail below, it is understood that the scope of this invention is not limited by this description. In the presently preferred embodiment of the current invention, the top end portion 22 of the insert 18 has a cylindrical shape and is threaded, as shown in FIGS. 3, 5, and 8. Referring to FIG. 3, in use, the top end portion 22 of the insert 18 is preferably received by a corresponding aperture 36 in the tool tray 30. The area of the aperture 36 is preferably slightly greater than the area of the cross-section of the top end portion 22 of the insert 18 to allow the top end portion 22 of the insert 18 to project through the aperture 36. The tool tray 30 then rests on the top ends 16 (see FIG. 6) of the support members 12, and the tool tray 30 is secured to each support member 12 by tightening fasteners, preferably wingnuts 40, to the threaded top end portion 22 of the insert 18, as shown in FIG. 3. Although FIG. 3 illustrates the use of wingnuts 40 to secure the tool tray 30 to the top ends 16 of the support members 12, any type of tightening fasteners may be used. By tightening fastener is meant any structure or structures that both tightens (to tighten the foot end 14 against the housings E, F and the tool tray 30 against the top end 16) and fastens (to secure the insert 18 in the tightened position). It is furthermore understood that this configuration is not the only way to secure the tool tray 30 to the support members 12. Although the use of wingnuts 40 to secure the threaded top end portion 22 of the insert 18 is currently the preferred embodiment, the tool tray 30 may be secured to the support members 12 by any one of a number of similar or dissimilar equivalent structures that are well within the skill of an ordinary artisan.

Figure 10:
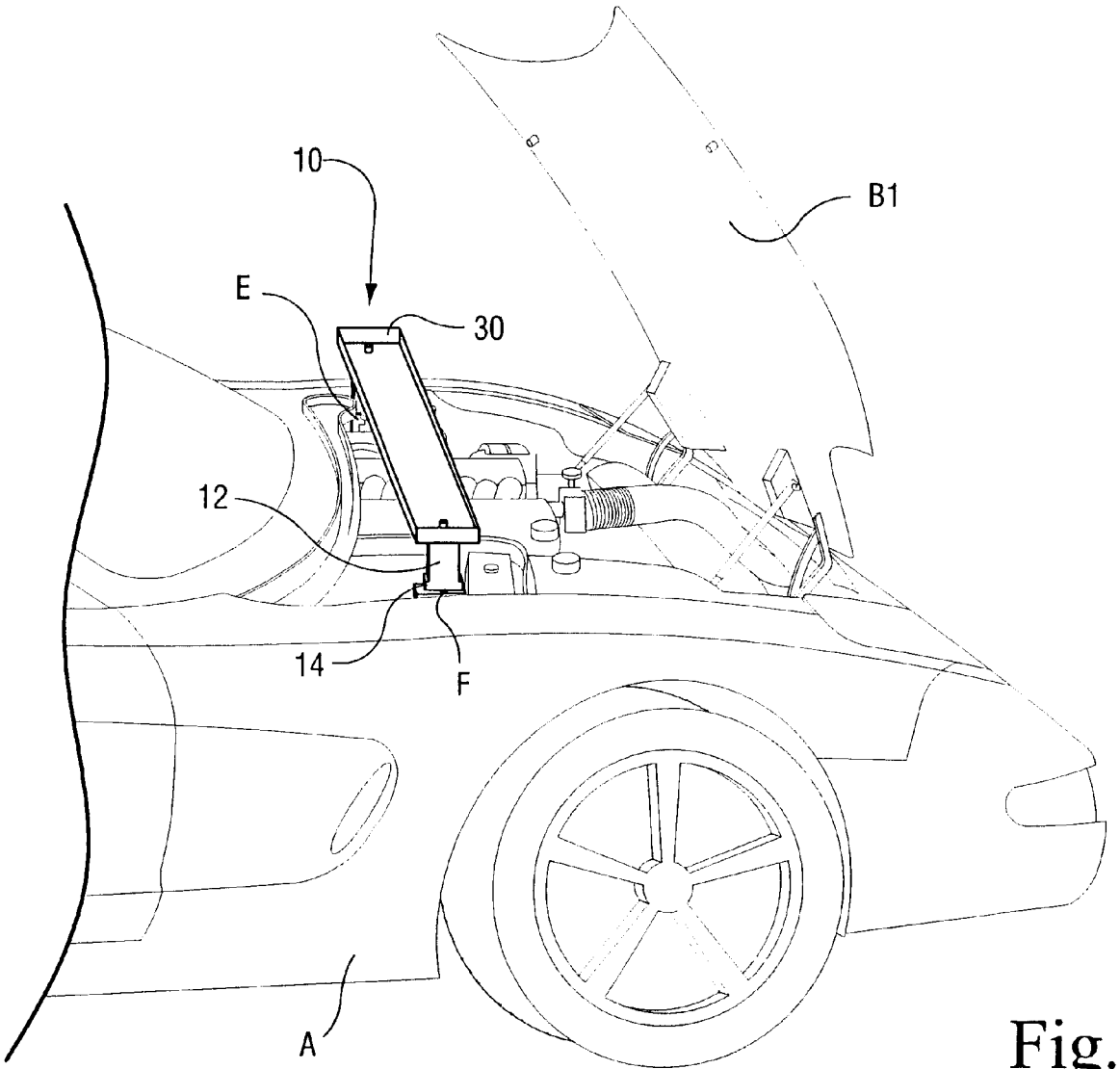
FIG. 10 is a side perspective view of the assembled automotive tool tray and support assembly of FIG. 3 showing the automotive tool tray and support assembly in use on an automobile having a rear-raising hood.

The tool tray 30 is preferably rectangular in shape and has a bottom plate 32 and four side walls 34. However, the tool tray 30 is not limited to being rectangular in shape, but can be square, circular or any other shape. The shape and size of the tool tray 30 is substantially constrained by two design considerations: (1) the tool tray 30 must adapted to engage and rest on the top ends 16 of the support members 12 when the support members 12 engage the hood latch mechanisms C, D as shown in FIG. 10; and (2) the tool tray 30 should have a relatively unobtrusive presence in the engine compartment H (i.e., it should not block access to the engine compartment H when in use). The tool tray 30 is also adapted to be preferably removably affixed to the support members 12. It is understood that the tool tray 30 may be affixed to the support members 12 in any one of a number of ways. Although, as described above, the tool tray 30 is described as having apertures 36 configured and positioned to receive the threaded top end portions 22 of the inserts 18 to be secured by wingnuts 40, it is understood that this description is no limitation. On the contrary, the tool tray 30 can have any one of a number of similar or dissimilar equivalent configurations that are well within the skill of an ordinary artisan.

Referring to FIGS. 9 and 10, the presently preferred embodiment of the invention is shown in use. Referring to FIG. 10, the invention in use comprises two support members 12 engaged in and retained by the left and right hood latch mechanisms C, D, with the tool tray 30 affixed to the top ends 16 (not shown) of the support members 12. Referring to FIG. 9, a support member 12 is preferably first positioned over the left and right hood latch mechanisms C, D. The latch end portion 20 of each insert 18 is inserted into the respective hood latch mechanism C, D. The hood latch mechanism C, D then engages and retains the latch end portion 20 of the insert 18. Once the hood latch mechanism C, D engages the latch end portion 20 of the insert 18, the support member 12 can then be urged downward along the insert 18 until the foot end 14 of the support member 12 rests on the hood latch mechanism housing E, F. Referring to FIGS. 3 and 9, after the support members 12 are affixed to the left and right hood latch mechanisms C, D, the tool tray 30 may then be affixed to the support members 12 in the manner as described above.

Figure 11:
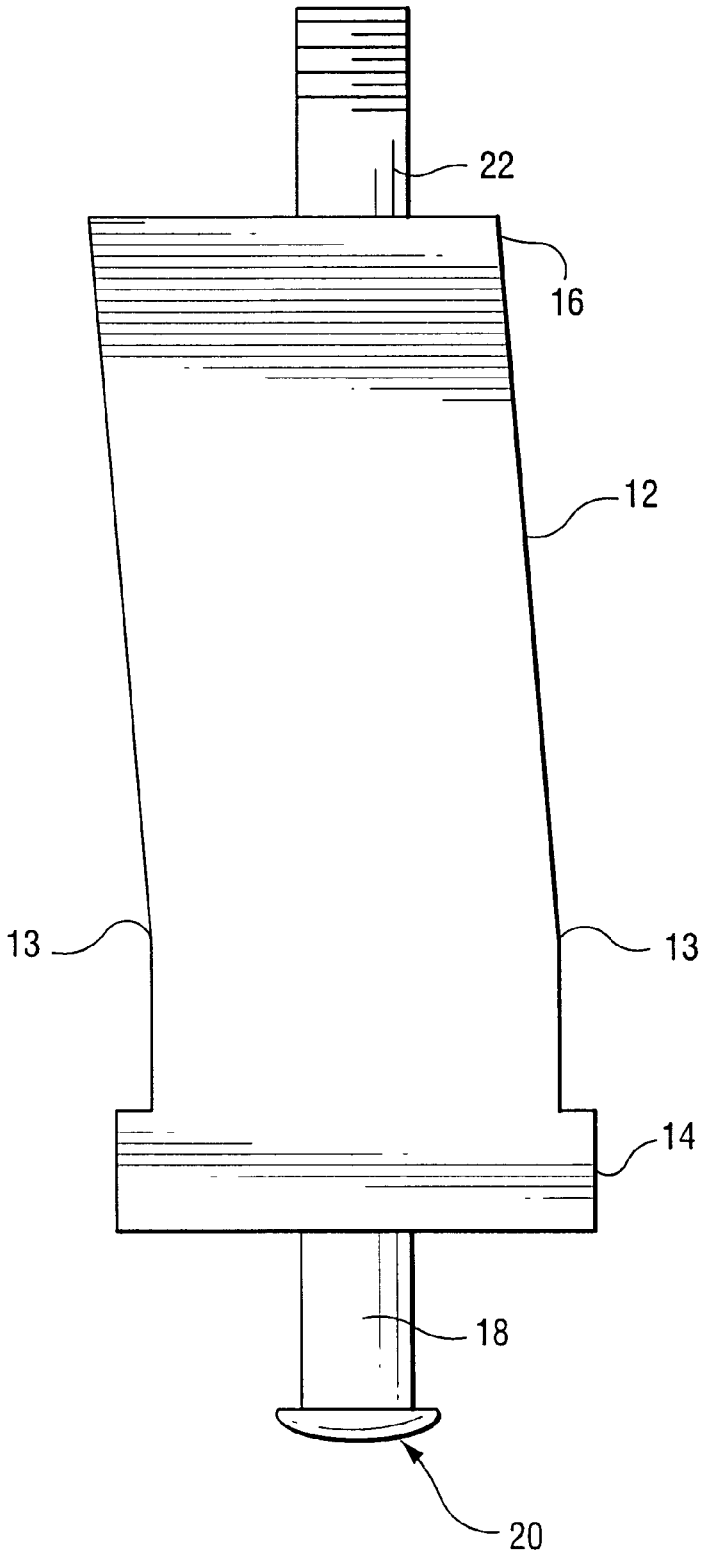
FIG. 11 is a side elevational view of an alternative embodiment of the support member, showing the bend intermediate between the foot end and top end of the support member.

In certain automobiles, the hood latch housing mechanisms E, F may have a top surface offset from the horizontal. To compensate for this angle offset, referring to FIG. 11, in an alternative embodiment of the present invention, the support member 12 may be formed with at least one curve or bend 13 equal to the offset angle intermediately located between the foot end 14 and the top end 16 of the support member 12. In this alternative embodiment of the present invention, the support member 12 preferably has one bend 13. The angle of the bend 13 should correspond to the offset angle of the hood latch mechanism housing E, F. Support members 12 having the angle of the bend 13 range between zero degrees (0°) and ten degrees (10°) should accommodate the offset angle of the hood latch mechanism housing E, F of all automobiles having rear-raising hoods. However, the support member 12 may have more than one bend 13 (not shown in FIG. 11), so long as the sum effect of all bends 13 compensates for the offset angle of the hood latch mechanism housing E, F.

Because the hood latch mechanisms C, D engage and retain the latch end portions 20 of the inserts 18, and because the tool tray 30 is secured against the support members 12 using the top end portions 22 of the inserts 18, the invention is substantially rigidly affixed in place over the engine compartment H of the automobile A. This reduces the likelihood of jostling or overturning the tool tray 30, and therefore reduces the chances of losing tools or parts placed in the tool tray 30. When the invention must be removed from the engine compartment H of the automobile A, the hood latch mechanisms C, D are released, which in turn releases the latch end portions 20 of the inserts 18. The tool tray 30 and support members 12 may then be removed from the engine compartment H.

The tool tray 30 and support members 12 are preferably constructed of inexpensive and lightweight material such as aluminum. Furthermore, the inserts 18 may be adapted from readily available existing parts, such as carriage bolts.

Figure 12:
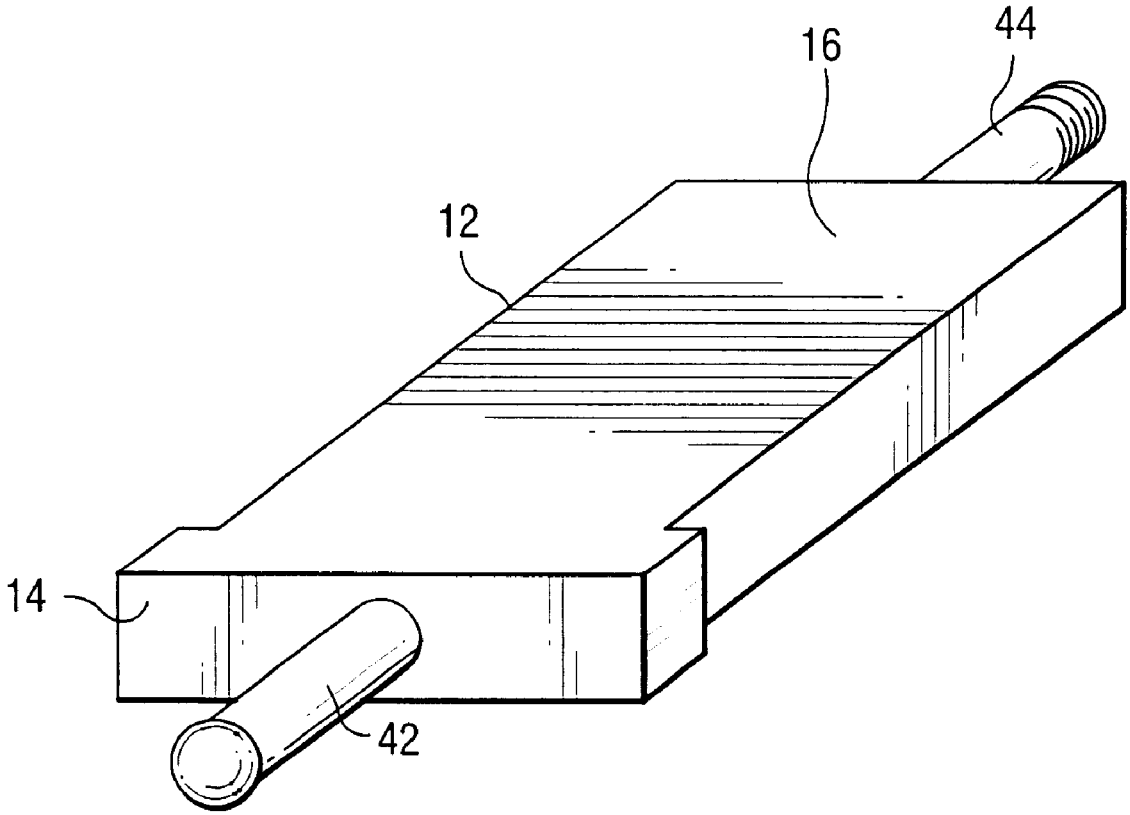
FIG. 12 is a side perspective view of an alternative embodiment of the support member in a horizontal orientation, showing legs or mini-legs rigidly affixed to the foot end and top end of the support member.

Referring to FIG. 12, an alternative embodiment of the support member 12 contemplates the use of mini-legs or legs (collectively referred to as "legs") 42, 44 rigidly affixed to the foot end 14 and top end 16 of the support member 12 instead of an insert 18. The foot leg 42 is rigidly affixed to the foot end 14 of the support member 12, and each foot leg 42 is preferably adapted to be inserted into the hood latch mechanisms C, D. Similarly, the top leg 44 is rigidly affixed to the top end 16 of the support member 12 and is preferably adapted to be received by and affixed to a tool tray 30. The tool tray 30 can then be secured to the support member 12 by the top leg 44 via the use of tightening fasteners as discussed above, or by any one of a number of similar or dissimilar equivalent structures that are well within the skill of an ordinary artisan.

While the invention has been disclosed in connection with the particular preferred embodiments disclosed herein, those skilled in the art will appreciate that many alterations and modifications in the details of the invention can be made without departing from the scope and spirit of the invention. Accordingly, no limitations are to be implied or inferred in the invention, except as specifically and explicitly set forth in the attached claims.

INDUSTRIAL APPLICABILITY

This invention can be used whenever it is desired to have an unobtrusive yet conveniently positioned automotive tool tray that will not be upset or overturned when performing maintenance or repairs on an automobile having a rear-raising hood.

What is claimed is:

1. A device that removably engages with first and second hood latch mechanisms in first and second hood latch mechanism housings on opposite sides of an engine compartment of a motor vehicle having a rear-raising hood, said device comprising:

a first support member having a foot end, a top end, and a leg extending from said foot end, said leg adapted to be engagable with and retained by said first hood latch mechanism, and said foot end being adapted to rest on said first hood latch mechanism housing;

a second support member having a foot end, a top end, and a leg extending from said foot end, said leg adapted to be engagable with and retained by said second hood latch mechanism, and said foot end being adapted to rest on said second hood latch mechanism housing;

a tool tray adapted to be supported by said top ends of said first and second support members;

whereby said first support member may be substantially rigidly and removably affixed to said first hood latch mechanism by inserting said leg in said first hood latch mechanism and engaging and retaining said leg with said first hood latch mechanism, whereby said foot end of said first support member rests on said first hood latch mechanism housing;

whereby said second support member is substantially rigidly and removably affixed to said second hood latch mechanism by inserting said leg in said second hood latch mechanism and engaging and retaining said leg with said second hood latch mechanism, whereby said foot end of said second support member rests on said second hood latch mechanism housing; and whereby said tool tray may be positioned over said engine compartment by affixing said tray to said top ends of said first and second support members.

2. A device that removably engages with first and second hood latch mechanisms in first and second hood latch mechanism housings on opposite sides of an engine compartment of a motor vehicle having a rear-raising hood, said device comprising:

a hollow first support member having an open foot end, a top end, and an extendable first insert having a latch end portion adapted to be engagable with and retained by said first hood latch mechanism, said first insert being movably disposed within said first support member, whereby said latch end portion extends through said open foot end, said foot end being adapted to rest on said first hood latch mechanism housing;

a hollow second support member having an open foot end, a top end, and an extendable second insert having a latch end portion adapted to be engagable with and retained by said second hood latch mechanism, said second insert being movably disposed within said second support member wherein said latch end portion extends through said open foot end, said foot end being adapted to rest on said second hood latch mechanism housing;

a tool tray adapted to be supported by said top ends of said first and second support members;

whereby said first support member may be substantially rigidly and removably affixed to said first hood latch mechanism by inserting said latch end portion of said first insert in said first hood latch mechanism and engaging and retaining said latch end portion with said first hood latch mechanism, whereby said foot end of said first support member rests on said first hood latch mechanism housing;

whereby said second support member is substantially rigidly and removably affixed to said second hood latch mechanism by inserting said latch end portion of said second insert in said second hood latch mechanism and engaging and retaining said latch end portion with said second hood latch mechanism, whereby said foot end of said second support member rests on said second hood latch mechanism housing; and whereby said tool tray may be positioned over said engine compartment by affixing said tray to said top ends of said first and second support members.

3. A device for removably engaging first and second hood latch mechanisms in first and second hood latch mechanism housings on opposite sides of an engine compartment of a motor vehicle having a rear-raising hood, said device comprising:

a tool tray;

a first support member having a top end and a bottom end, said bottom end of said first support member being adapted to rest on said first hood latch mechanism housing, said first support member having a substantially central, substantially vertical bore extending through said top and bottom ends;

a second support member having a top end and a bottom end, said bottom end of said second support member being adapted to rest on said second hood latch mechanism housing, said second support member having a substantially central, substantially vertical bore extending through said top and bottom ends;

a first insert longer than said first support member having a latch end portion and a top end portion, said first insert being movably disposed within said bore wherein said latch end portion extends through said bottom end of said first support member, and said top end portion extends through said top end of said first support member, said latch end portion being adapted to be engagable with and retained by said first hood latch mechanism, and said top end portion being adapted to receive said tool tray;

a second insert longer than said second support member having a latch end portion and a top end portion, said second insert being movably disposed within said bore wherein said latch end portion extends through said bottom end of said second support member, and said top end portion extends through said top end of said second support member, said latch end portion being adapted to be engagable with and retained by said second hood latch mechanism, and said top end portion being adapted to receive said tool tray;

whereby said first support member may be substantially rigidly and removably affixed to said first hood latch mechanism by inserting said latch end portion of said first insert in said first hood latch mechanism, and engaging and retaining said latch end portion with said first hood latch mechanism, whereby said bottom end of said first support member rests on said first hood latch mechanism housing;

whereby said second support member may be substantially rigidly and removably affixed to said second hood latch mechanism by inserting said latch end portion of said second insert in said second hood latch mechanism, and engaging and retaining said latch end portion with said second hood latch mechanism, whereby said bottom end of said second support member rests on said second hood latch mechanism housing; and whereby said tool tray may be positioned over said engine compartment by affixing said tool tray to said top ends of said first and second support members and to said top end portions of said first and second inserts.

4. A device that removably engages with first and second hood latch mechanisms in first and second hood latch mechanism housings on opposite sides of an engine compartment of a motor vehicle having a rear-raising hood, said device comprising:

a tool tray;

a hollow first support member having an open top end and an open bottom end, said bottom end of said first support member being adapted to rest on said first hood latch mechanism housing, and said top end of said first support member being adapted to support said tool tray;

a first insert having a latch end portion and a top end portion, said first insert being movably disposed within said first support member wherein said latch end portion extends from said open bottom end of said first support member, and said top end portion extends from said open top end of said first support member, said latch end portion being adapted to be engagable with and retained by said first hood latch mechanism, and said top end portion being adapted to be engagable with and removably affixed to said tool tray;

a hollow second support member having an open top end and an open bottom end, said bottom end of said second support member being adapted to rest on said second hood latch mechanism housing, and said top end of said second support member being adapted to support said tool tray;

a second insert having a latch end portion and a top end portion, said second insert being movably disposed within said second support member wherein said latch end portion extends from said open bottom end of said second support member, said top end portion extends from said open top end of said second support member, said latch end portion being adapted to be engagable with and retained by said second hood latch mechanism, and said top end portion being adapted to be engagable with and removably affixed to said tool tray;

whereby said first support member may be substantially rigidly and removably affixed to said first hood latch mechanism by inserting said latch end portion of said first insert in said first hood latch mechanism and engaging and retaining said latch end portion with said first hood latch mechanism, whereby said bottom end of said first support member rests on said first hood latch mechanism housing;

whereby said second support member may be substantially rigidly and removably affixed to said second hood latch mechanism by inserting said latch end portion of said second insert in said second hood latch mechanism and engaging and retaining said latch end portion with said second hood latch mechanism, whereby said bottom end of said second support member resting on said second hood latch mechanism housing; and whereby said tool tray may be positioned over said engine compartment by engaging and removably affixing said tray to said top end portions of said first and second inserts, and resting said tool tray on said top ends of said first and second support members.

5. A support assembly according to any one of claims 1, 2, 3, or 4 wherein said support member further comprises at least one bend defined by a bend angle intermediate between said top ends and said bottom ends of said first and second support members.

6. A support assembly according to claim 5, wherein said bend angle of each of said bends is between zero degrees (0°) and ten degrees (10°).

* * * * *